US011181064B2

(12) United States Patent
Inaba

(10) Patent No.: US 11,181,064 B2
(45) Date of Patent: Nov. 23, 2021

(54) INJECTION CONTROL DEVICE

(71) Applicant: DENSO CORPORATION, Kariya (JP)

(72) Inventor: Masashi Inaba, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/104,276

(22) Filed: Nov. 25, 2020

(65) Prior Publication Data

US 2021/0164413 A1 Jun. 3, 2021

(30) Foreign Application Priority Data

Nov. 28, 2019 (JP) ..... JP2019-215373

(51) Int. Cl.

*F02D 41/20* (2006.01)
*F02D 41/38* (2006.01)
*F02D 41/06* (2006.01)

(52) U.S. Cl.

CPC ..... *F02D 41/20* (2013.01); *F02D 41/38* (2013.01); *F02D 41/062* (2013.01); *F02D 2041/2013* (2013.01); *F02D 2041/2027* (2013.01); *F02D 2041/2058* (2013.01); *F02D 2041/2065* (2013.01); *F02D 2041/2068* (2013.01)

(58) Field of Classification Search

CPC ..... F02D 41/20; F02D 41/38; F02D 41/201; F02D 41/2003–2013; F02D 41/2027; F02D 41/2058; F02D 41/2065; F02D 41/2068

See application file for complete search history.

(56) References Cited

U.S. PATENT DOCUMENTS 7,516,733 B2 * 4/2009 Stephan ..... F02M 53/06 123/445
8,096,485 B2 * 1/2012 Hlousek ..... F02M 51/061 239/13
8,339,762 B2 * 12/2012 North ..... F02M 53/06 361/161
10,125,730 B2 * 11/2018 Yanoto ..... F02D 41/40
2008/0127918 A1 6/2008 Wineland et al.

* cited by examiner

*Primary Examiner* — Sizo B Vilakazi
*Assistant Examiner* — Mark L. Greene
(74) *Attorney, Agent, or Firm* — Posz Law Group, PLC

(57) ABSTRACT

An injection control device controls the opening and closing of a fuel injection valve by performing peak current drive and constant current drive and controls injection of fuel from the fuel injection valve to an internal combustion engine. The injection control device includes a preheat current energization control unit configured to, when a temperature of a solenoid coil of the fuel injection valve prior to starting the internal combustion engine is lower than a predetermined temperature, energize the fuel injection valve with a preheat current having an output density that causes the temperature of the solenoid coil to increase, the preheat current being within a range that maintains the fuel injection valve in a valve closed state, and when the temperature of the solenoid valve increases to or above the predetermined temperature, stop the energization of the fuel injection valve with the preheat current.

6 Claims, 5 Drawing Sheets

INJECTION CONTROL DEVICE

CROSS REFERENCE TO RELATED APPLICATION

The present application claims the benefit of priority from Japanese Patent Application No. 2019-215373 filed on Nov. 28, 2019. The entire disclosure of the above application is incorporated herein by reference.

TECHNICAL FIELD

The present invention relates to an injection control device.

BACKGROUND

An injection control device controls the opening and closing of a fuel injection valve by performing peak current drive and constant current drive with respect to the fuel injection valve, and controls the injection of fuel from the fuel injection valve to an internal combustion engine.

SUMMARY

In one aspect of the present disclosure, an injection control device controls the opening and closing of a fuel injection valve by performing peak current drive and constant current drive with respect to the fuel injection valve and controls injection of fuel from the fuel injection valve to an internal combustion engine. The injection control device includes a preheat current energization control unit configured to, when a temperature of a solenoid coil of the fuel injection valve prior to starting the internal combustion engine is lower than a predetermined temperature, energize the fuel injection valve with a preheat current having an output density that causes the temperature of the solenoid coil to increase, the preheat current being within a range that maintains the fuel injection valve in a valve closed state, and when the temperature of the solenoid valve increases to or above the predetermined temperature, stop the energization of the fuel injection valve with the preheat current.

DETAILED DESCRIPTION

Figure 1:
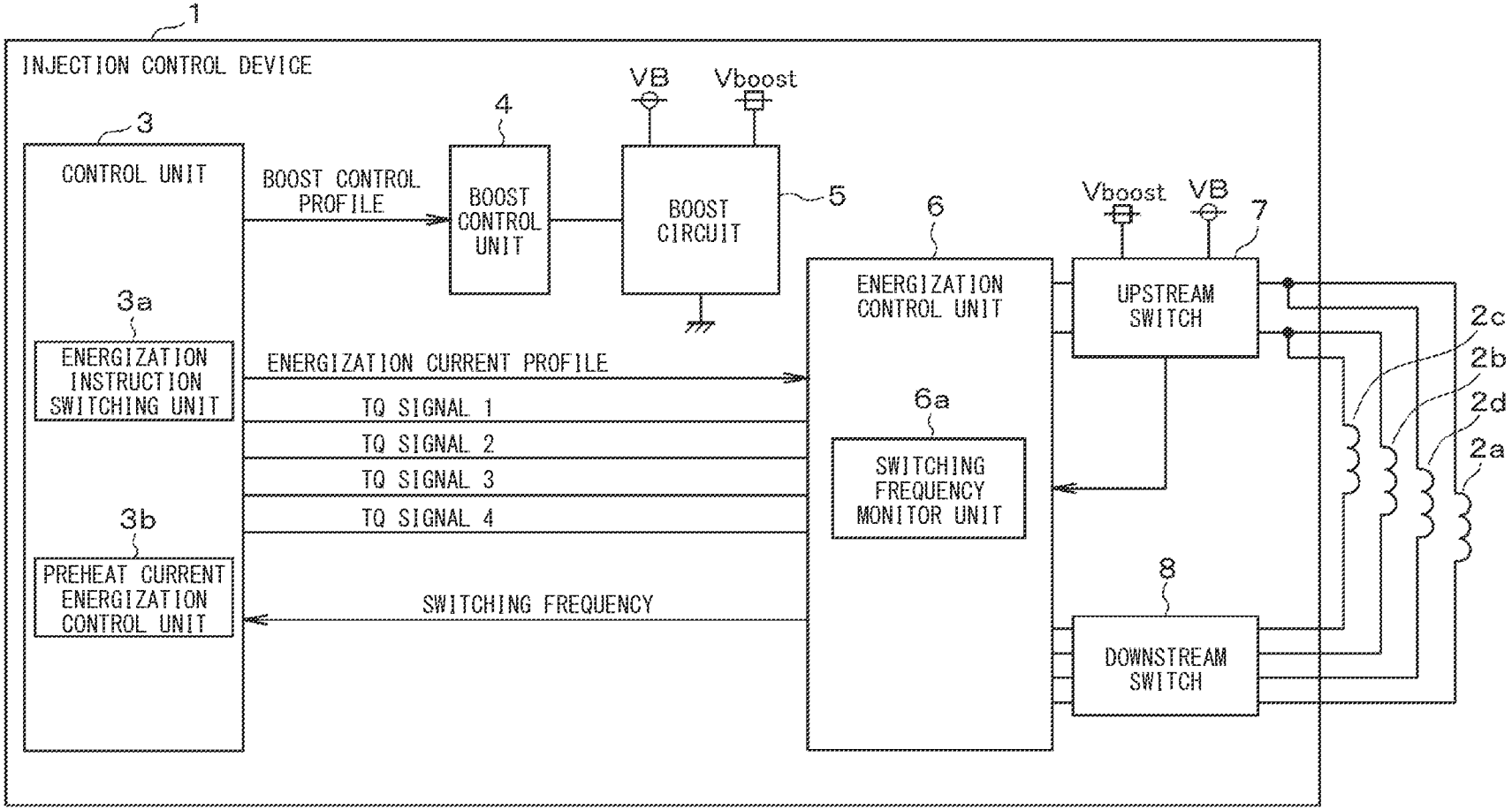
FIG. 1 is a functional block diagram.

Hereinafter, embodiments of the present disclosure will be described with reference to drawings. In the embodiments, elements corresponding to those which have been described in the preceding embodiments are denoted by the same reference numerals, and redundant description may be omitted.

During cold start when the temperature of a solenoid coil of a fuel injection valve is less than a specified temperature, the peak current rises sharply due to the temperature characteristics of the solenoid coil, and there is a risk that the energy supplied to the fuel injection valve may be insufficient. As a result, the actual injection amount may be significantly reduced from the instructed injection amount, and there is a risk of deterioration of the A/F ratio or misfires. In order to prevent this, a configuration that detects the slope of the current and increases the peak current can be considered, but in such a configuration, it is necessary to design a circuit that matches the maximum value of the peak current value, which may increase the size and cost of the device. On the other hand, although there are various technologies for heating the fuel injection valve, heating function and heating completion determination functions would be required on both the fuel injection valve side and the injection control device side, and there are still concerns about increases in size and cost of the device. The present disclosure describes embodiments and features to address these concerns.

First Embodiment

Figure 2:
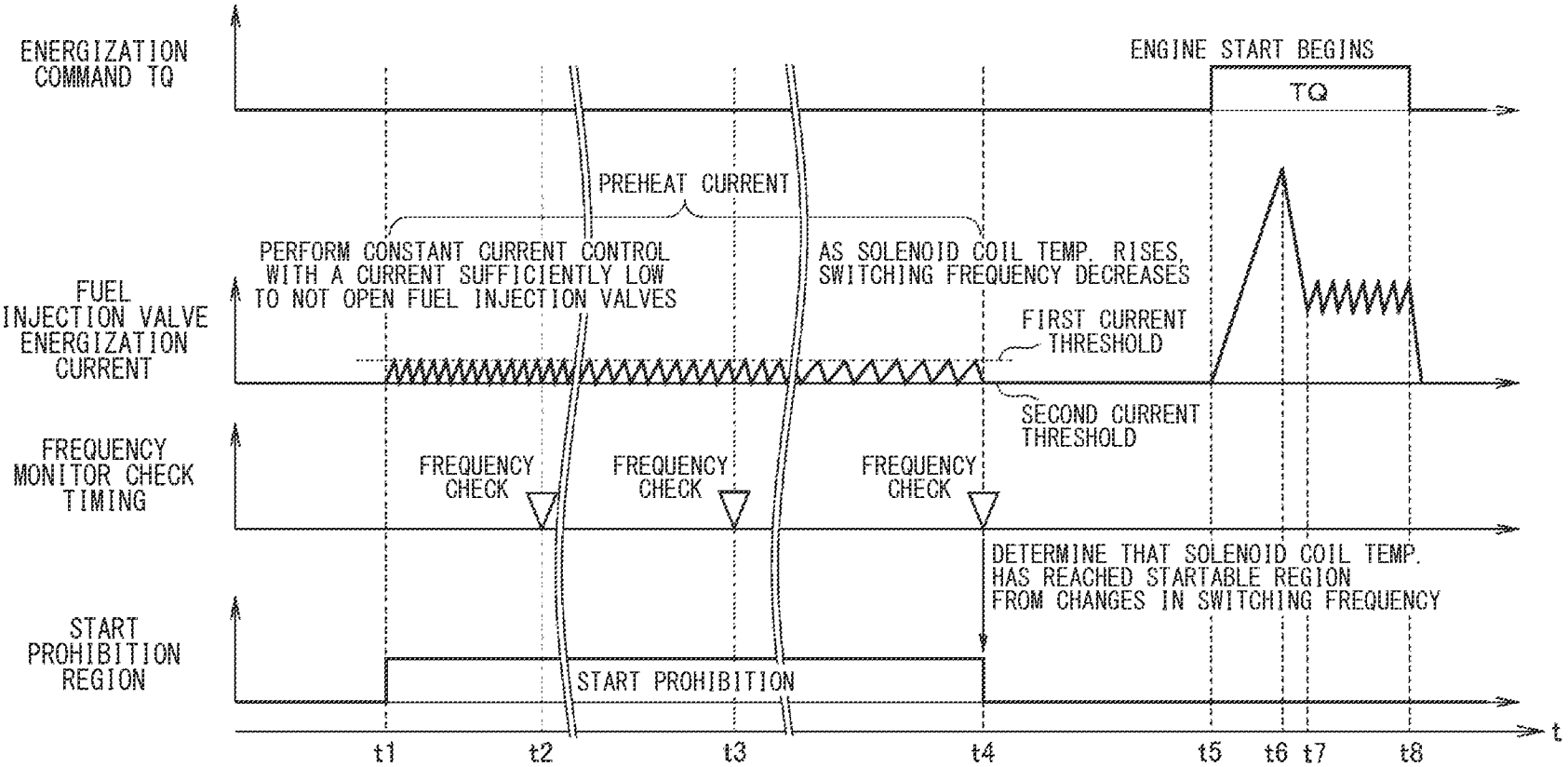
FIG. 2 is a timing chart.

The first embodiment will be described with reference to FIGS. 1 to 2. As shown in FIG. 1, an injection controller 1 is a device that controls the driving of solenoid-type fuel injection valves 2*a* to 2*d*. The fuel injection valves 2*a* to 2*d* are configured to inject fuel into an internal combustion engine mounted on a vehicle such as an automobile. The injection controller 1 is implemented as an electronic control unit (ECU). The fuel injection valve 2*a* and the fuel injection valve 2*d* are arranged in cylinders having opposite phases. As such, the injection of the fuel injection valve 2*a* and the injection of the fuel injection valve 2*d* do not overlap with each other. The fuel injection valve 2*b* and the fuel injection valve 2*c* are arranged in cylinders having opposite phases. As such, the injection of the fuel injection valve 2*b* and the injection of the fuel injection valve 2*c* do not overlap with each other. In other words, the injection of the fuel injection valve 2*a* and the injection of the fuel injection valve 2*d* are in an overlapping relationship with the injection of the fuel injection valve 2*b* and the injection of the fuel injection valve 2*c*. In the present embodiment, the illustrated configuration shows four fuel injection valves 2*a* to 2*d* corresponding to four cylinders, but any number of cylinders may be used. For example, the present disclosure may be applied to six cylinders or eight cylinders.

The injection control device 1 includes a control unit 3, a boost control unit 4, a boost circuit 5, an energization control unit 6, an upstream switch 7, and a downstream switch 8. The control unit 3 mainly includes a microcontroller that further includes a CPU, a ROM, a RAM, an I/O, and the like. The control unit 3 performs various processing operations based on programs stored in, for example, the ROM. The control unit 3 includes an energization instruction switching unit 3*a* and a preheat current energization control unit 3*b* as functions for performing various processing operations. The function produced by the control unit 3 may be provided by software stored in the ROM, which is a non-transient memory device, by a computer that executes the software, by only software, by only hardware, or by a combination thereof.

The energization instruction switching unit 3*a* receives a sensor signal from sensors (not shown) provided externally and specifies injection command timings by using the inputted sensor signals. When the energization instruction switching unit 3*a* specifies the injection command timings, the energization instruction switching unit 3*a* switches TQ signals 1 to 4 on and off in order to instruct the energization time periods according to the specified injection command timings. The TQ signals 1 to 4 correspond to the fuel injection valves 2*a* to 2*d*.

The boost control unit 4 acquires a boost control profile from the control unit 3 via a serial communication path and stores the acquired boost control profile in an internal memory. The boost control unit 4 performs a boost switching control of the boost circuit 5 according to the boost control profile stored in the internal memory.

The boost circuit 5 is a DC-DC converter that generates a boost power source for performing peak current driving. The boost circuit 5 uses a boost chopper circuit including an inductor, a MOS transistor as a switching element, a current detection resistor, a diode, a boost capacitor, and the like. A boost control unit 4 switches and controls the MOS transistor in the boost circuit 5 to rectify the energy stored in the inductor using the diode, and stores the rectified energy in the boost capacitor. The boost capacitor holds a boost voltage Vboost (e.g. 65V) higher than a battery voltage VB (e.g. 12V).

When the boost voltage Vboost drops to (or falls below) a predetermined boost start voltage Vsta, the boost control unit 4 starts performing boost control. A boost completion voltage Vfu is set so that when the boost voltage Vboost reaches the boost completion voltage Vfu, the boost voltage Vboost exceeds the boost start voltage Vsta. When the boost voltage Vboost reaches the boost completion voltage Vfu, the boost control is terminated. During normal operation, the boost control unit 4 controls the boost voltage Vboost to approach the boost completion voltage Vfu while ensuring that this boost voltage Vboost can be output.

The energization control unit 6 acquires an energization current profile from the control unit 3 via a serial communication path and stores the acquired energization current profile in its internal memory. When the energization control unit 6 detects the on/off switching of the TQ signals 1 to 4, the energization control unit 6 drives the upstream switch 7 and the downstream switch 8 according to the energization current profile stored in the internal memory.

The upstream switch 7 is a switch provided on the upstream side of the fuel injection valves 2*a* to 2*d*. The upstream switch 7 includes a peak current drive switch configured to switch on and off the discharge of the boost voltage Vboost to the fuel injection valves 2*a* to 2*d*, and a battery voltage drive switch for performing a constant current control by using the battery voltage VB. The peak current drive switch and the battery voltage drive switch may for example be n-channel type MOS transistor, but other types of transistors such as bipolar transistors may be used as well. Further, the upstream switch 7 outputs the switching frequency of the switching control of the battery voltage drive switch to the energization control unit 6.

The downstream switch 8 is a switch provided on the downstream side of the fuel injection valves 2*a* to 2*d*, and includes low-side drive switches for selecting a cylinder. Similar to the peak current drive switch and the battery voltage drive switch, the low-side drive switches may be n-channel type MOS transistor, but other types of transistors such as bipolar transistors may be used as well.

The energization control unit 6 includes a switching frequency monitor unit 6*a*. The switching frequency monitor unit 6*a* monitors the switching frequency of the battery voltage drive switch and outputs the monitored switching frequency to the control unit 3. The switching frequency monitor unit 6*a* may performing this monitoring by, for example, calculating the number of times that the battery voltage drive switch of the upstream switch 7 is switched during a predetermined period of time. The switching frequency monitor unit 6*a* may monitor the switching frequency with a predetermined period or may constantly monitor the switching frequency.

The preheat current energization control unit 3*b* outputs a preheat current energization start instruction to the energization control unit 6 when the temperature of the solenoid coils of the fuel injection valves 2*a* to 2*d* before starting the internal combustion engine is lower than a predetermined temperature. When this preheat current energization start instruction is output, the fuel injection valves 2*a* to 2*d* are energized with a preheat current. The preheat current is a current with an output density that raises the temperature of the solenoid coil and within a range which maintains a valve closed state, i.e., within a range which does not exceed the spring force maintaining the valve closed state. In particular, the preheat current is switch controlled by the battery voltage drive switch to range between a first current threshold and a second current threshold.

After starting energization of the fuel injection valves 2*a* to 2*d* with the preheat current, the preheat current energization control unit 3*b* monitors the temperature change of the solenoid coil using the switching frequency input from the energization control unit 6. That is, when the temperature of the solenoid coil gradually rises due to the energization of the fuel injection valves 2*a* to 2*d* with the preheat current, the LCR characteristics gradually change and the switching frequency gradually decreases. Due to this, the preheat current energization control unit 3*b* is configured to determine that the temperature of the solenoid coil has risen to a predetermined temperature by determining that the switching frequency input from the energization control unit 6 has decreased to a predetermined frequency. When the preheat current energization control unit 3*b* determines that the temperature of the solenoid coil has risen to a predetermined temperature, it outputs a preheat current energization end instruction to the energization control unit 6 and ends the energization of the fuel injection valves 2*a* to 2*d* with the preheat current.

An operation of the configuration described above is explained next with reference to FIG. 2. Here, it is assumed that the temperature of the solenoid coils of the fuel injection valves 2*a* to 2*d* is initially lower than a predetermined temperature, for example, when the user performs an ignition operation. When the ignition switch is turned on by, for example, the user performing an ignition operation, the control unit 3 outputs a preheat current energization start instruction to the energization control unit 6 and starts energizing the fuel injection valves 2*a* to 2*d* with the preheat current (t1). At this time, the control unit 3 turns on a start prohibition flag as an internal state. When the control unit 3 starts energizing the fuel injection valves 2*a* to 2*d*, the temperature of the solenoid coils gradually rises, the LCR characteristics gradually change, and the switching frequency gradually decreases. The control unit 3 periodically monitors the temperature change of the solenoid coils by periodically monitoring changes in the switching frequency input from the energization control unit 6 (t2 to t4).

When the control unit 3 determines that the switching frequency has dropped to a predetermined frequency, the control unit 3 determines that the temperature of the solenoid coils has risen to a predetermined temperature, and determines that the temperature of the solenoid coils has reached a startable region of the internal combustion engine (t4). When the control unit 3 determines that the temperature of the solenoid coil has reached the startable region of the internal combustion engine, the control unit 3 outputs a preheat current energization end instruction to the energization control unit 6 to terminate the energization of the fuel injection valves 2*a* to 2*d* with the preheat current. At this time, the control unit 3 turns off the start prohibition flag as an internal state.

After that, when the control unit 3 specifies the injection command timings of the fuel injection valves 2*a* to 2*d*, the control unit 3 switches the TQ signals 1 to 4 on and off, executes peak current drive and battery voltage drive, and energizes the fuel injection valve to start the internal combustion engine (t5 to t8).

According to the first embodiment, the following effects can be exhibited. In the injection control device 1, when the temperature of the solenoid coils of the fuel injection valves 2*a* to 2*d* before the start of the internal combustion engine is less than a predetermined temperature, a preheat current is applied to the fuel injection valves 2*a* to 2*d* to heat the solenoid coils. Then, the energization of the fuel injection valves 2*a* to 2*d* with the preheat current is stopped when the temperature reaches the predetermined temperature or higher. By raising the temperature of the solenoid coil to a predetermined temperature or higher at the time of starting the internal combustion engine, the slope of the increase in peak current is reduced and the energy required for valve opening can be supplied in a stable manner to the fuel injection valves 2*a* to 2*d*. In this case, a heating function and a heating completion determination function does not need to be provided on both the fuel injection valves 2*a* to 2*d* side and the injection control device 1 side. As a result, the energy required for valve opening can be appropriately supplied to the fuel injection valves 2*a* to 2*d* while avoiding increases in the size and cost of the device.

Further, the switching frequency of the constant current switching control is monitored, and when the switching frequency drops to a predetermined frequency, the energization of the preheat current to the fuel injection valves 2*a* to 2*d* is stopped. This can be achieved by using the correlation between the change in switching frequency and the change in the solenoid coil temperature. Further, in the above description, an exemplary configuration is described in which the preheat current energization is performed by a switching control on the battery voltage drive switch is illustrated, but the preheat current energization may be performed by a switching control on the peak current drive switch instead as an alternative.

Second Embodiment

Figure 3:
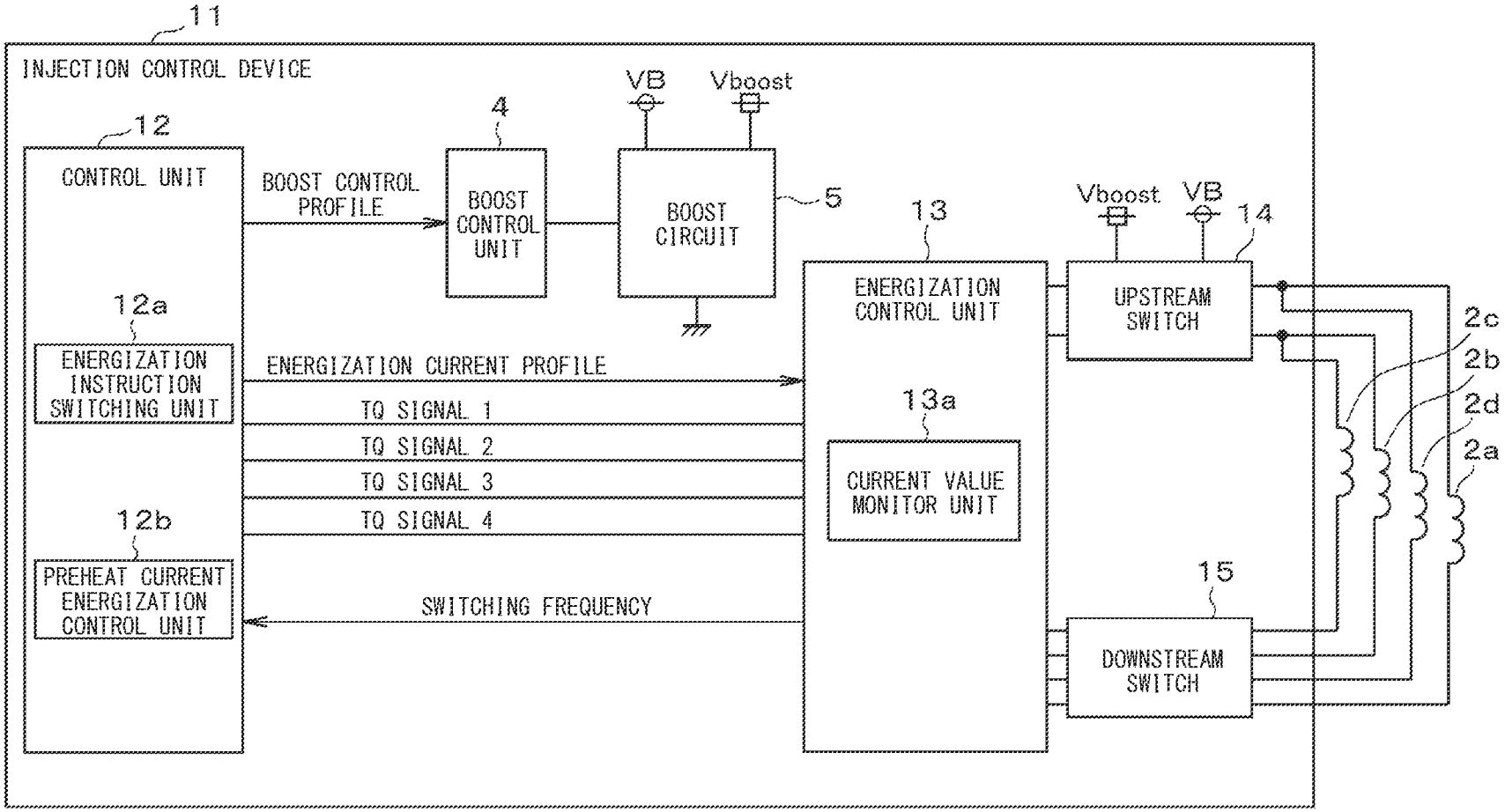
FIG. 3 is a functional block diagram.

The second embodiment will be described with reference to FIGS. 3 to 5. The second embodiment is different from the first embodiment in that the correlation between the change in the current value of the preheat current and the temperature change in the solenoid coil is used.

The injection control device 11 includes a control unit 12, an energization control unit 13, a boost control unit 4, a boost circuit 5, an upstream switch 14, and a downstream switch 15. The control unit 12 includes an energization instruction switching unit 12*a* and a preheat current energization control unit 12*b* as functions for performing various processing operations. The energization instruction switching unit 12*a* is equivalent to the energization instruction switching unit 3*a* described in the first embodiment.

The energization control unit 13 acquires an energization current profile from the control unit 12 via a serial communication path and stores the acquired energization current profile in its internal memory. When the energization control unit 13 detects the on/off switching of the TQ signals 1 to 4, the energization control unit 13 drives the upstream switch 14 and the downstream switch 15 according to the energization current profile stored in the internal memory. The upstream switch 14 generates a preheat current by performing PWM (pulse width modulation) control at a predetermined frequency and a predetermined duty ratio using a battery voltage drive switch or a peak current drive switch. The downstream switch 15 outputs the current value of the preheat current to the energization control unit 13.

The energization control unit 13 includes a current value monitor unit 13*a*. The current value monitor unit 13*a* monitors the current value of the preheat current, and outputs the monitored current value of the preheat current to the control unit 12. The current value monitoring unit 13*a* may monitor the current value of the preheat current with a predetermined period or may constantly monitor the current value.

The preheat current energization control unit 12*b* outputs a preheat current energization start instruction to the energization control unit 13 when the temperature of the solenoid coils of the fuel injection valves 2*a* to 2*d* before starting the internal combustion engine is lower than a predetermined temperature. When this preheat current energization start instruction is output, the fuel injection valves 2*a* to 2*d* are energized with the preheat current. The preheat current is a current with an output density that raises the temperature of the solenoid coil and within a range which maintains a valve closed state, i.e., within a range which does not exceed the spring force maintaining the valve closed state. In particular, the preheat current is generated by the battery voltage drive switch or the peak current drive switch using PWM controls.

After starting energization of the fuel injection valves 2*a* to 2*d* with the preheat current, the preheat current energization control unit 12*b* monitors the temperature change of the solenoid coil using the current value of the preheat current input from the energization control unit 13. That is, when the temperature of the solenoid coil gradually rises due to the energization of the fuel injection valves 2*a* to 2*d* with the preheat current, the LCR characteristics gradually change and the current value of the preheat current gradually decreases. Due to this, the preheat current energization control unit 12*b* is configured to determine that the temperature of the solenoid coil has risen to a predetermined temperature by determining that the current value of the preheat current input from the energization control unit 13 has decreased to a predetermined value. When the preheat current energization control unit 12*b* determines that the temperature of the solenoid coil has risen to a predetermined temperature, it outputs a preheat current energization end instruction to the energization control unit 13 and ends the energization of the fuel injection valves 2*a* to 2*d* with the preheat current.

Next, the operation of the above configuration will be described with reference to FIGS. 4 and 5. In this case, the preheat current is generated by performing PWM control at a predetermined frequency and a predetermined duty ratio using the battery voltage drive switch or the peak current drive switch.

Figure 4:
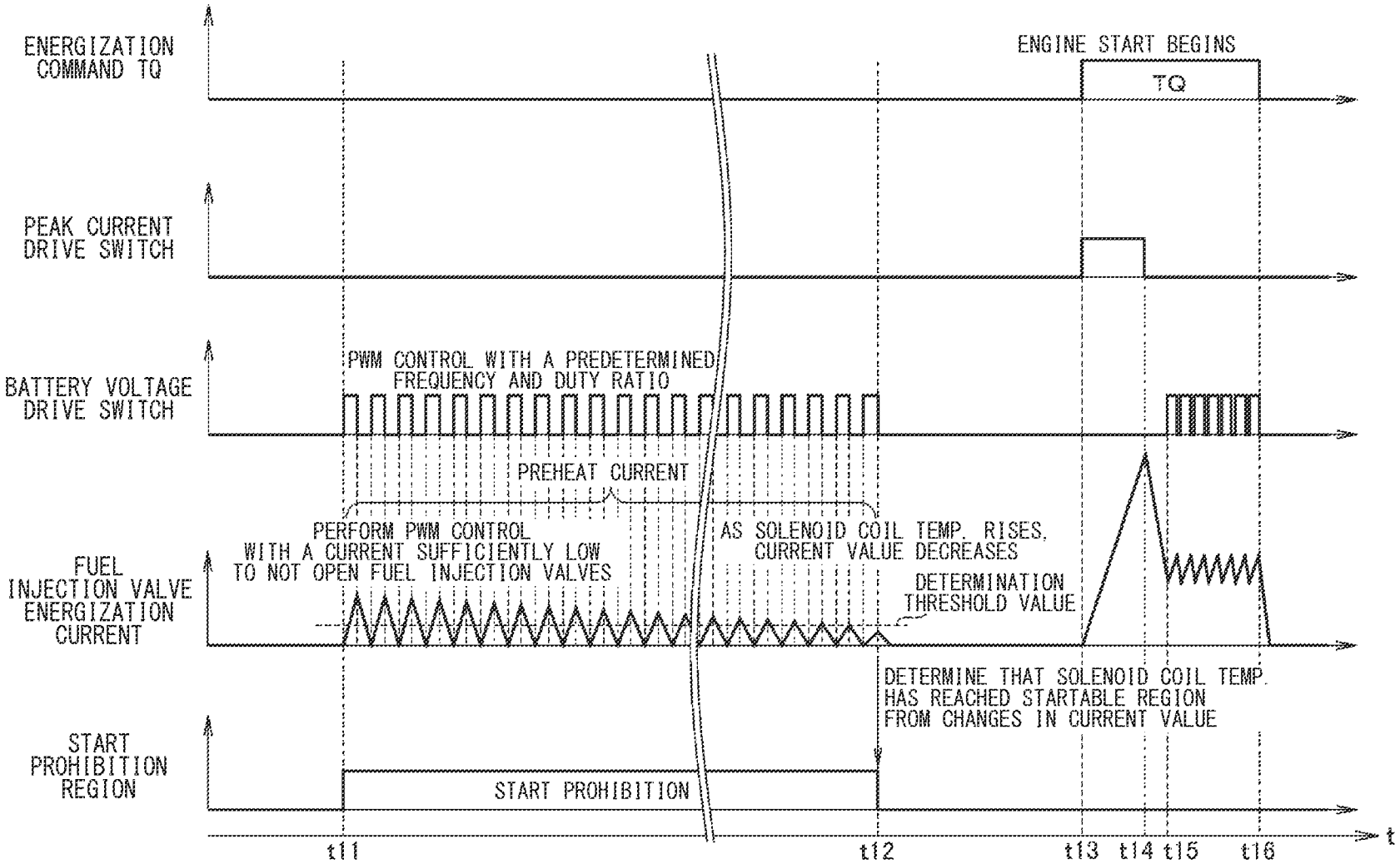
FIG. 4 is a timing chart.

FIG. 4 shows when the battery voltage drive switch is used to perform PWM control at a predetermined frequency and a predetermined duty ratio. Here, when the ignition switch is turned on by, for example, the user performing an ignition operation, the control unit 12 outputs the preheat current energization start instruction to the energization control unit 13, starts the PWM control of the battery voltage drive switch, and starts energizing the fuel injection valves 2*a* to 2*d* with the preheat current (t11). At this time, the control unit 12 turns on the start prohibition flag as an internal state. When the control unit 12 starts energizing the fuel injection valves 2*a* to 2*d*, the temperature of the solenoid coils gradually rises, the LCR characteristics gradually change, and the current value of the preheat current gradually decreases. The control unit 12 constantly monitors the temperature change of the solenoid coil by constantly monitoring the change in the current value of the preheat current input from the energization control unit 13.

When the control unit 12 determines that the current value of the preheat current has decreased to a determination threshold value (corresponding to a predetermined value), the control unit 12 determines that the temperature of the solenoid coils has risen to a predetermined temperature, and determines that the temperature of the solenoid coils has reached a startable region of the internal combustion engine (t12). When the control unit 12 determines that the temperature of the solenoid coil has reached the startable region of the internal combustion engine, the control unit 12 outputs a preheat current energization end instruction to the energization control unit 13 to terminate the energization of the fuel injection valves 2*a* to 2*d* with the preheat current. At this time, the control unit 12 turns off the start prohibition flag as an internal state.

After that, when the control unit 12 specifies the injection command timings of the fuel injection valves 2*a* to 2*d*, the control unit 12 switches the TQ signals 1 to 4 on and off, executes peak current drive and battery voltage drive, and energizes the fuel injection valve to start the internal combustion engine (t13 to t16).

Figure 5:
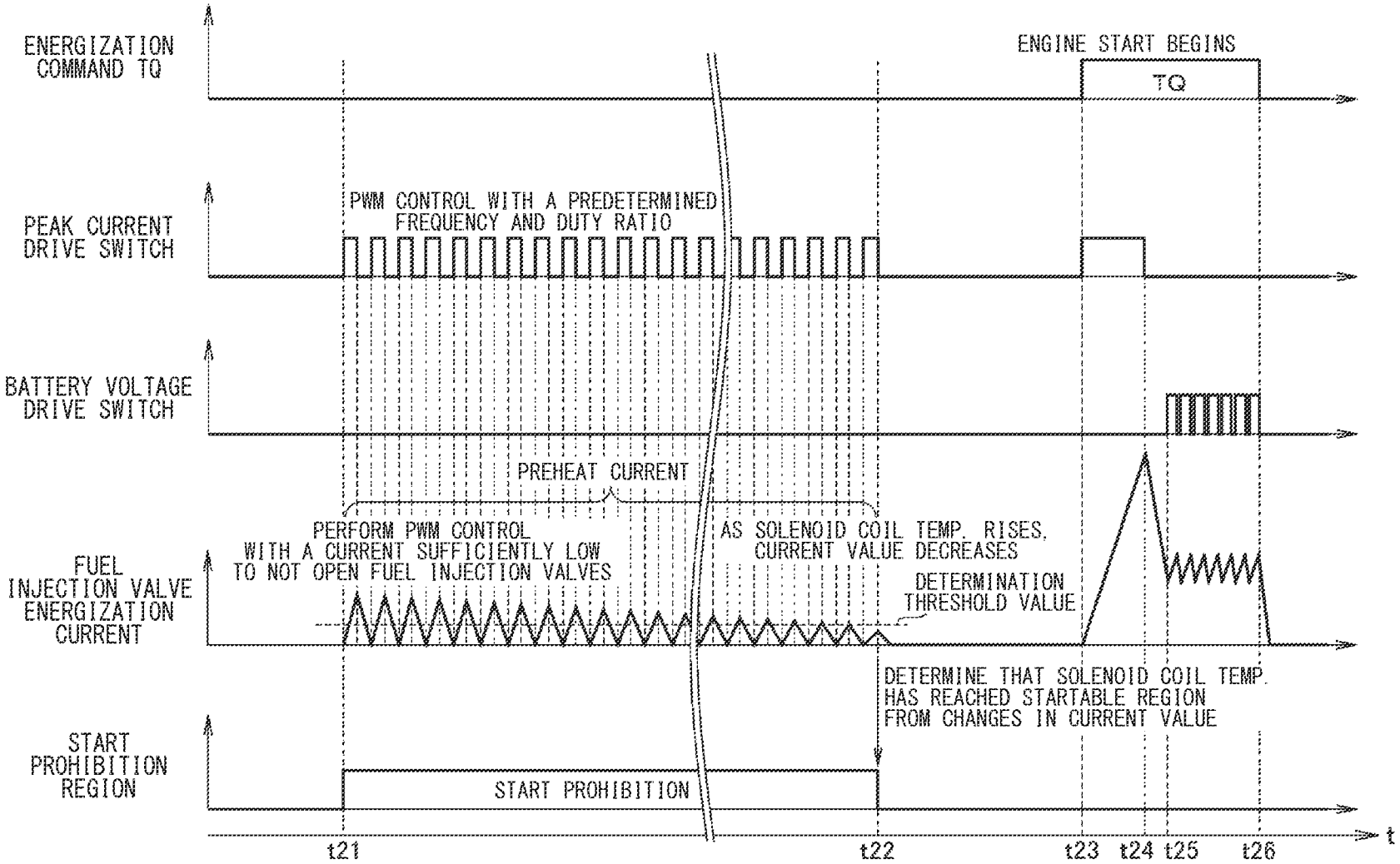
FIG. 5 is a timing chart.

FIG. 5 shows when the peak current drive switch is used to perform PWM control at a predetermined frequency and a predetermined duty ratio. Here, when the ignition switch is turned on by, for example, the user performing an ignition operation, the control unit 12 starts the PWM control of the peak current drive switch, and starts energizing the fuel injection valves 2*a* to 2*d* with the preheat current (t21). After that, the control unit 12 performs the same processing as when the battery voltage drive switch is used to perform PWM control (t22 to t26).

According to the second embodiment, the following effects can be exhibited. In the injection control device 11, when the temperature of the solenoid coils of the fuel injection valves 2*a* to 2*d* before the start of the internal combustion engine is less than a predetermined temperature, a preheat current is applied to the fuel injection valves 2*a* to 2*d* to heat the solenoid coils. Then, the energization of the fuel injection valves 2*a* to 2*d* with the preheat current is stopped when the temperature reaches the predetermined temperature or higher. Similar to the first embodiment, by raising the temperature of the solenoid coil to a predetermined temperature or higher at the time of starting the internal combustion engine, the slope of the increase in peak current is reduced and the energy required for valve opening can be supplied in a stable manner to the fuel injection valves 2*a* to 2*d*. In this case as well, a heating function and a heating completion determination function does not need to be provided on both the fuel injection valves 2*a* to 2*d* side and the injection control device 11 side. As a result, the energy required for valve opening can be appropriately supplied to the fuel injection valves 2*a* to 2*d* while avoiding increases in the size and cost of the device.

Further, the current value of the preheat current by PWM control is monitored, and when the current value of the preheat current drops to a predetermined value, the energization of the preheat current to the fuel injection valves 2*a* to 2*d* is stopped. This can be achieved by using the correlation between the change in the current value of the preheat current and the temperature change in the solenoid coil. Further, by using PWM control with a fixed frequency, noise emission performance can be improved.

The waveform of the constant current switching control may be approximated to a triangular wave, an effective value may be calculated by the following formula, and the effective value may be compared with the determination threshold value.

$$\text{Effective value} = \text{lower limit value} + (\text{upper limit value} - \text{lower limit value})/\sqrt{3}$$

Other Embodiments

Although the present disclosure has been described in accordance with the examples, it is understood that the present disclosure is not limited to such examples or structures. The present disclosure encompasses various modifications and variations within the scope of equivalents. Additionally, various combinations and configurations, as well as other combinations and configurations including more, less, or only a single element, are within the scope and spirit of the present disclosure.

The invention claimed is:

1. An injection control device that controls the opening and closing of a fuel injection valve by performing a peak current drive and a constant current drive with respect to the fuel injection valve and controls injection of fuel from the fuel injection valve to an internal combustion engine, comprising:

a preheat current energization control unit configured to when a temperature of a solenoid coil of the fuel injection valve prior to starting the internal combustion engine is lower than a predetermined temperature, energize the fuel injection valve with a preheat current having an output density that causes the temperature of the solenoid coil to increase, the preheat current being within a range that maintains the fuel injection valve in a valve closed state, and when the temperature of the solenoid valve increases to or above the predetermined temperature, stop the energization of the fuel injection valve with the preheat current, wherein the preheat current energization control unit is configured to:

energize the fuel injection valve by performing constant current switching control on the preheat current between a first current threshold and a second current threshold, and when a switching frequency of the constant current switching control falls under a predetermined frequency, stop the energization of the fuel injection valve with the preheat current.

2. The injection control device of claim 1, wherein the preheat current energization control unit uses a battery voltage to energize the fuel injection valve with the preheat current.

3. The injection control device of claim 1, wherein the preheat current energization control unit uses a boost voltage to energize the fuel injection valve with the preheat current.

4. An injection control device that controls the opening and closing of a fuel injection valve by performing a peak current drive and a constant current drive with respect to the fuel injection valve and controls injection of fuel from the fuel injection valve to an internal combustion engine, comprising:

a preheat current energization control unit configured to when a temperature of a solenoid coil of the fuel injection valve prior to starting the internal combustion engine is lower than a predetermined temperature, energize the fuel injection valve with a preheat current having an output density that causes the temperature of the solenoid coil to increase, the preheat current being within a range that maintains the fuel injection valve in a valve closed state, and when the temperature of the solenoid valve increases to or above the predetermined temperature, stop the energization of the fuel injection valve with the preheat current, wherein the preheat current energization control unit is configured to:

energize the fuel injection valve with the preheat current by performing PWM control, and when a current value of the preheat current falls under a predetermined value, stop the energization of the fuel injection valve with the preheat current.

5. The injection control device of claim 4, wherein the preheat current energization control unit uses an effective value as the predetermined value of the preheat current.

6. An injection control system, comprising:

a fuel injection valve configured to inject fuel into an internal combustion engine, the fuel injection valve including a solenoid coil that controls an open or closed state of the fuel injection valve;

a drive circuit connected to the fuel injection valve, the drive circuit being configured to selectively energize the fuel injection valve; and a controller including a processor programmed to:

prior to starting the internal combustion engine, determine whether a temperature of the solenoid coil is lower than a predetermined temperature, upon determining that the temperature of the solenoid coil is lower than the predetermined temperature, control the drive circuit to energize the fuel injection valve with a preheat current having an output density that causes the temperature of the solenoid coil to increase, the preheat current being within a range that maintains the fuel injection valve in the closed state, and when the temperature of the solenoid valve increases to or above the predetermined temperature, stop the energization of the fuel injection valve with the preheat current, wherein the controller is configured to:

energize the fuel injection valve by performing a constant current switching control on the preheat current between a first current threshold and a second current threshold, and when a switching frequency of the constant current switching control falls under a predetermined frequency, stop the energization of the fuel injection valve with the preheat current.

* * * * *